United States Patent [19]

Manservisi et al.

[11] Patent Number: 4,513,908

[45] Date of Patent: Apr. 30, 1985

[54] WRAPPER SHEET FOR CIGARETTE PACKS, AND METHOD FOR OBTAINING SAME

[75] Inventors: Renato Manservisi, Bologna; Mario Fossi, Funo di Argelato, both of Italy

[73] Assignee: Sasib S.p.A., Bologna, Italy

[21] Appl. No.: 281,191

[22] Filed: Jul. 7, 1981

[30] Foreign Application Priority Data

Jul. 15, 1980 [IT] Italy ..... T5213/80[U]

[51] Int. Cl.[3] ..... B65D 65/00; B65D 75/00

[52] U.S. Cl. ..... 229/87 C; 206/273; 131/329

[58] Field of Search ..... 131/329, 358; 229/87 C; 206/273

[56] References Cited

U.S. PATENT DOCUMENTS

| | | | |
|---|---|---|---|
| 2,559,000 | 7/1951 | Back | 229/87 C |
| 3,276,668 | 10/1966 | Tamarin | 229/87 C |
| 3,333,683 | 8/1976 | Scharre | 229/87 C |

FOREIGN PATENT DOCUMENTS

| | | | |
|---|---|---|---|
| 819219 | 10/1951 | Fed. Rep. of Germany | 131/365 |
| 544414 | 9/1922 | France | 131/365 |
| 18827 | of 1912 | United Kingdom | 131/365 |

*Primary Examiner*—V. Millin

*Attorney, Agent, or Firm*—Spencer & Frank

[57] ABSTRACT

The wrapper sheet (1) for forming the outer wrapping in cigarette packs of the so-called "soft or american" type, has the outline of a rectangle with a bevel angle (101) and, in correspondence of the angle adjacent to the bevel angle, with an appendix (201) projecting out of the ideal contour of the rectangle and being exactly alike to the triangle cut out from the bevel angle. Upon folding of the outer wrapper (1) around the tinfoil-wrapped cigarette pack, the two bottom flaps result to be both shaped as isosceles trapeziums, while the appendix comes to be concealed under one of said flaps.

2 Claims, 2 Drawing Figures

WRAPPER SHEET FOR CIGARETTE PACKS, AND METHOD FOR OBTAINING SAME

BACKGROUND AND SUMMARY OF THE INVENTION

The present invention relates to a wrapper sheet, particularly adapted for forming the outer wrapper in cigarette packs of the so-called "soft or american" type, and to a method for obtaining same.

In the manufacture of the so-called "soft or american" packs, a group of cigarettes, usually twenty in three superposed rows of seven, six and seven, is firstly wrapped inside a tinfoil wrapper, and the said tinfoil-wrapped pack is then finally enclosed inside an outer wrapper consisting of a substantially rectangular paper sheet wrapped around the tinfoil pack so that one of its smaller edges overlaps the other smaller edge and is caused to adhere thereto by glueing along a line parallel to and close to one of the longitudinal corners of the cigarette pack. The outer paper wrapper terminates, in correspondence of the top head end of the pack (i.e. the end which is intended to be opened for use) at a short distance from the head end corners, and it is usually closed by a closure label (such as for example a duty stamp) which bridges over the said top head end and is glued by its extremities to the edges of the outer paper wrapper on both major sides of the cigarette pack. At the bottom head end of the cigarette pack, the outer paper wrapper is mechanically folded so as to form two superposed flaps which are glued together.

By using rectangular wrapper sheets, the above mentioned wrapping operation gives origin to an inconvenience which affects the outer appearance of the cigarette pack. In fact, the mechanical folding of the outer wrapper sheet in correspondence of the bottom head end of the pack leads to the formation of two flaps one of which has the contour of an isosceles trapezium, while the other has the contour of a rectangular trapezium, due to the actual impossibility of folding the angle section of the edge of the sheet which is superposed and glued to the other underlying edge.

In order to avoid this inconvenience, and to obtain a cigarette pack in which the bottom end of the outer wrapper sheet results from the superposition of two identical flaps having each the contour of an isosceles trapezium, presently there are employed outer wrapper sheets which are rectangular and present one bevel angle. The use of the said bevelled rectangular sheets does not create any problem whenever they are fed to the wrapping machine from a feeding hopper containing a pile of superposed sheets. If on the other hand it is desired to cut the single sheets from a continuously running paper web, it is necessary to provide for pick-up means (usually pneumatic means) for picking and eliminating the waste off-cuts consisting of small paper triangles resulting from the cutting of the bevel angle. The said pick-up means obviously constitute a constructive complication for the wrapping machine.

According to the present invention, the wrapper sheet for forming the outer wrapper in cigarette packs of the so-called "soft or american" type, is characterized by the fact that it has the outline of a rectangle with a bevel angle and, in correspondence of the angle adjacent to the said bevel angle, with an appendix projecting out of the ideal contour of the rectangle, said appendix being exactly alike to the triangle cut out from the bevel angle. The said wrapper sheet is obtained from a continuous paper web by subjecting the running paper web to subsequent cutting operations, each cutting operation providing an angular cut comprising a longer section transverse to the running direction of the web, and a shorter terminal section, forming with the said longer transverse section an angle equal to the bevel angle. It is apparent that each cutting operation takes place without the production of any waste off-cuts.

When the outer wrapper sheet is folded around the tinfoil pack, the flaps which close the bottom end of the pack result to be both shaped as isosceles trapeziums, while the appendix comes to be concealed under one of the said flaps, and therefore it does not disturb the outer appearance of the cigarette pack.

The above and other features of the invention, and the advantages deriving therefrom, will appear evident from the following detailed description of one preferred embodiment, made with reference to the Figures of the attached drawing.

DESCRIPTION OF THE PREFERRED EMBODIMENT

Figure 1:
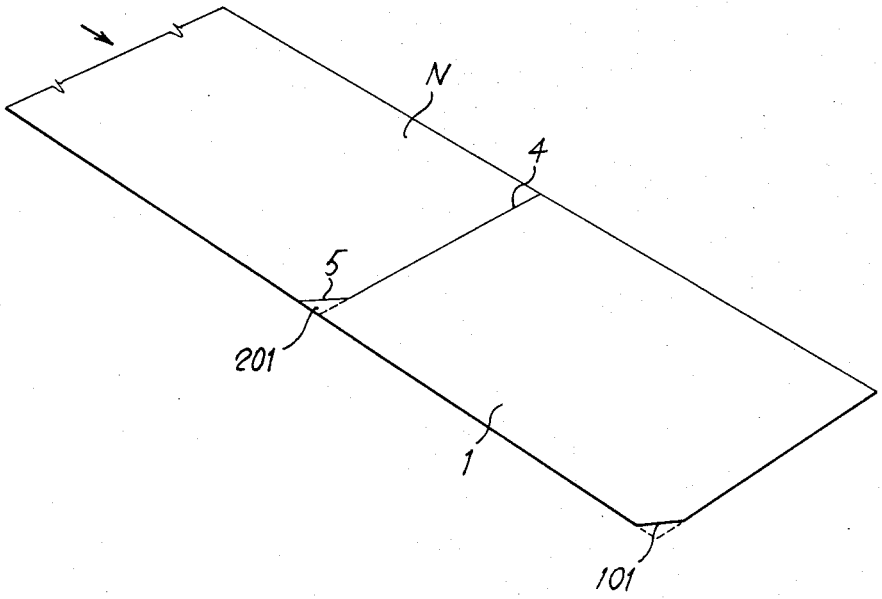
FIG. 1 shows in perspective view a wrapper sheet according to the invention while it is being obtained from a continuous web of wrapping material.

With reference to FIG. 1 of the drawings, a paper sheet 1 which forms the outer wrapper of a pack of cigarette of the so-called "soft or american" type, is formed by subsequently cutting individual sheets from a continuous paper web N. The paper sheet 1 presents the outline of a rectangle with a bevel angle 101 and, on the adjacent angle, with an appendix 201 projecting out of the ideal contour of the basic rectangle and which appendix 201 is exactly alike to the triangle cut out from the bevel angle 101. The dash lines clearly illustrate the above mentioned basic concept.

Each subsequent cut effected on the running web N presents therefore a substantially longer transverse cutting line 4, and a short terminal cutting line 5 set at a predetermined bevel angle with respect to the transverse cutting line 4. It appears evident that at each cutting operation, by adopting the described angular cutting, there is delivered a sheet 1 with the triangular appendix 201, while the bevel angle 101 has been preformed at the preceding cutting operation, and at the same time there is also simultaneously obtained the bevel angle 101 in the subsequent sheet. It is apparent that the above cutting operation takes place without the production of any waste off-cuts.

Figure 2:
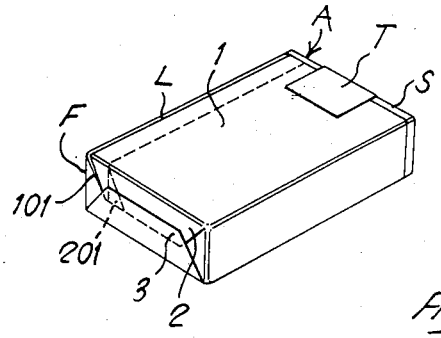
FIG. 2 shows in perspective view, from the bottom head end, a cigarette pack of the so-called "soft or american" type, in which the outer paper wrapper has been realized by employing a wrapper sheet according to FIG. 1.

The paper sheet 1 thus obtained is particularly advantageous for being used for the outer wrapping of cigarette packs of the so-called "soft or american" type, such as the one indicated by reference letter A in FIG. 2.

In this kind of cigarette packs, the group of cigarettes, usually twenty cigarettes arranged in superposed rows of seven, six and seven cigarettes, is firstly wrapped inside an inner wrapping S of tinfoil, and the said tinfoil-wrapped pack is then wrapped inside the paper sheet 1 which folded so that one transverse edge, and more precisely the edge presenting the bevel angle 101, overlaps the other edge (the one carrying the triangle appendix 201) and is caused to adhere thereto by glueing along a glueing line L parallel to and close to one of the longitudinal corners of the cigarette pack A, next to the longitudinal narrow side F of the pack itself.

The outer paper wrapper 1 terminates, in correspondence of the top head end of the pack A (i.e. the end which is intended to be opened for use), at a short distance from the head end corners, and it is usually closed by a closure label T (such as for example a duty stamp) which bridges over the said top head end and it is glued by its extremities to the edges of the outer wrapper 1 on both major sides of the pack A.

The bevel angle 101 and the triangle appendix 201 come to be located in correspondence of the bottom head end of the pack A, where the mechanical folding operation leads to the formation of two flaps 2, 3, having each the shape of an isosceles trapezium, said flaps being superposed the one over the other and glued so as to form the bottom end of the pack.

As it appears from FIG. 2, the triangle appendix 201 comes to be concealed under flap 2, in proximity of the bevel angle 101 and therefore it does not negatively affect the outer appearance of the pack A.

A wrapper sheet 1 according to the invention can be easily obtained, as above mentioned, from a continuous paper web N unreeled from a suitable supply bobbin (not shown) and moving in the direction of the arrow indicated at FIG. 1.

It is believed that the invention will have been clearly understood from the foregoing detailed description of one preferred embodiment. Changes in the details may be resorted to without departing from the basic concept of the invention, and it is accordingly intended that no limitation be implied and that the hereto annexed claims be given the broadest interpretation to which the employed language fairly admits.

We claim:

1. A wrapper sheet for forming the outer wrapping of a soft cigarette package, comprising a blank including a first portion and a second portion, said first and second portion having a common edge, said first portion having the shape of a rectangle and said second portion having the shape of a non-rectangular parallelogram joined to said first portion along the common edge.

2. A wrapper sheet for forming the outer wrapping sheet of a soft cigarette package comprising a blank having a generally rectangular configuration with a right triangular portion removed from one corner of said blank to form a bevelled edge and an appendage having the same shape as said removed portion projecting from a corner of said blank adjacent the one corner of said blank so that said blank has three pairs of opposite edges, with the edges of each pair being parallel and equal in length.

* * * * *